US008590245B2

(12) United States Patent
Peng et al.

(10) Patent No.: US 8,590,245 B2
(45) Date of Patent: Nov. 26, 2013

(54) BANDED LINER SYSTEM FOR METAL BUILDINGS

(75) Inventors: Ying Peng, New Albany, OH (US); David E. Musick, Heath, OH (US); Ernest C. Abney, Sanford, FL (US); Weigang Qi, Westerville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 12/793,416

(22) Filed: Jun. 3, 2010

(65) Prior Publication Data

US 2011/0061311 A1 Mar. 17, 2011

Related U.S. Application Data

(60) Provisional application No. 61/184,112, filed on Jun. 4, 2009.

(51) Int. Cl.
*E04D 13/16* (2006.01)

(52) U.S. Cl.
USPC ..... 52/407.4; 52/404.3; 52/409; 52/746.11

(58) Field of Classification Search
USPC ..... 52/407.3, 407.4, 408, 749.2, 746.11, 52/409, 749.12, 404.3
See application file for complete search history.

(56) References Cited

U.S. PATENT DOCUMENTS 2,148,281 A * 2/1939 Scott, Jr. ..... 52/454
4,027,611 A * 6/1977 Ward et al. ..... 29/243.5
4,044,521 A * 8/1977 Fischer et al. ..... 52/404.3
4,047,346 A * 9/1977 Alderman ..... 52/407.4
4,172,345 A * 10/1979 Alderman ..... 52/406.2
4,215,895 A * 8/1980 Phillips ..... 296/202
4,233,791 A * 11/1980 Kuhl et al. ..... 52/309.1
4,303,713 A * 12/1981 Clemensen et al. ..... 428/121
4,441,294 A * 4/1984 Riley ..... 52/404.3
4,446,664 A * 5/1984 Harkins ..... 52/404.3
4,573,298 A * 3/1986 Harkins ..... 52/404.3
4,736,552 A * 4/1988 Ward et al. ..... 52/94
4,870,798 A * 10/1989 Richter ..... 52/528
4,875,320 A * 10/1989 Sparkes ..... 52/406.1
5,119,612 A * 6/1992 Taylor et al. ..... 52/410
5,171,116 A * 12/1992 Gerhardt et al. ..... 411/368
5,197,239 A * 3/1993 Glynn et al. ..... 52/63
5,251,415 A * 10/1993 Van Auken et al. ..... 52/407.4
5,290,086 A * 3/1994 Tucker ..... 296/152
5,406,764 A * 4/1995 Van Auken et al. ..... 52/408
5,561,959 A * 10/1996 Alderman et al. ..... 52/407.3

(Continued)

FOREIGN PATENT DOCUMENTS

WO WO 9939063 A1 * 8/1999 ..... E04D 15/06

*Primary Examiner* — Brian Glessner
*Assistant Examiner* — Adriana Figueroa
(74) *Attorney, Agent, or Firm* — Calfee, Halter & Griswold LLP

(57) ABSTRACT

A roof structure of a building that has a pair of rafter beams and a pair of eave struts extending between and connected to the rafter beams includes a plurality of first banding strips. The first banding strips have opposite distal ends extending between and connected to the rafter beams. A plurality of second banding strips has opposite distal ends extending between and connected to the eave struts. A support sheet is supported on the first and second banding strips, and a shock absorbing member is attached between the support sheet and one of the rafter beams or the eave struts.

11 Claims, 6 Drawing Sheets

(56) References Cited

U.S. PATENT DOCUMENTS

| | | | | |
|---|---|---|---|---|
| 5,901,518 | A * | 5/1999 | Harkins | 52/404.3 |
| 5,966,877 | A * | 10/1999 | Hawes | 52/63 |
| 6,003,282 | A * | 12/1999 | Alderman et al. | 52/749.12 |
| 6,041,568 | A * | 3/2000 | Alderman et al. | 52/749.12 |
| 6,099,222 | A * | 8/2000 | Moore | 410/100 |
| 6,226,945 | B1 * | 5/2001 | Henry et al. | 52/408 |
| 6,233,889 | B1 * | 5/2001 | Hulsey | 52/302.1 |
| 6,302,463 | B1 * | 10/2001 | Moore et al. | 296/24.43 |
| 6,345,944 | B1 * | 2/2002 | Florence | 410/118 |
| 6,363,684 | B1 * | 4/2002 | Alderman et al. | 52/742.12 |
| 6,401,426 | B1 * | 6/2002 | Alderman et al. | 52/749.12 |
| 6,421,980 | B1 * | 7/2002 | Alderman et al. | 52/746.11 |
| 6,689,449 | B2 * | 2/2004 | Hasan et al. | 428/124 |
| 6,694,693 | B2 * | 2/2004 | Alderman | 52/478 |
| 6,817,644 | B2 * | 11/2004 | Moore | 296/24.43 |
| 6,840,015 | B1 * | 1/2005 | Ashley | 52/90.1 |
| 6,983,970 | B2 * | 1/2006 | Bateman | 296/24.43 |
| 7,032,356 | B2 * | 4/2006 | Layfield | 52/407.1 |
| 7,125,069 | B2 * | 10/2006 | Cacucci et al. | 296/190.03 |
| 7,665,576 | B2 * | 2/2010 | Pelletier | 182/45 |
| 7,861,478 | B2 * | 1/2011 | Kalkanoglu et al. | 52/410 |
| 2003/0126816 | A1 * | 7/2003 | Hasan et al. | 52/409 |
| 2003/0150171 | A1 * | 8/2003 | Kunzel et al. | 52/63 |
| 2005/0279040 | A1 * | 12/2005 | Panasik | 52/407.3 |

* cited by examiner

BANDED LINER SYSTEM FOR METAL BUILDINGS

CROSS REFERENCE TO RELATED APPLICATIONS

This application claims the benefit of U.S. Provisional Application No. 61/184,112 filed Jun. 4, 2009.

BACKGROUND

Referring now to FIG. 1, a known metal roof structure is illustrated at 10. The illustrated metal roof structure 10 defines one bay 8. The illustrated metal roof structure 10 includes parallel rafter beams 12 and 12*a* extending across the building in a first direction and a plurality of purlin beams 14, 14*a*, 14*b*, 14*c*, 14*d*, 14*e*, 14*f*, and 14*g* extending in a second direction substantially transverse to the first direction. The illustrated rafter beams 12 and 12*a* are endwall rafter beams, and are supported on endwall columns 11, only portions of which are shown in FIG. 1. In larger roof structures, intermediate rafter beams may be provided between the endwall rafter beams 12 and 12*a*. Endwalls (not shown) may be mounted between the endwall columns 11. The purlin beams 14 through 14*g*, inclusive, are mounted on top of the rafter beams 12 and 12*a* and extend substantially parallel to each other. Eave struts 16 and 16*a* define two perimeter edges of the metal roof structure 10. The eave struts 16 and 16*a* are also mounted on top of the rafter beams 12 and 12*a*. The rafter beams 12 and 12*a* define the other two perimeter edges of the illustrated metal roof structure 10. The purlin beams 14 through 14*g* also extend parallel to the eave struts 16 and 16*a*.

Blankets 18, 18*a*, 18*b*, 18*c*, 18*d*, 18*e*, 18*f*, 18*g*, and 18*h* of insulative material are individually placed in gaps or cavities defined between adjacent purlin beams 14 through 14*g* and in cavities between the eave struts 16 and 16*a* and the purlin beams 14 through 14*g*, respectively. In FIG. 1, the blanket 18*h* is shown installed and in place. The blanket 18*g* is shown partially installed and being rolled into position between the purlin beams 14*f* and 14*g*. A portion of each of the remaining blankets 18 through 18*f*, inclusive, have been removed for illustrative purposes in order to more clearly show the structure of the metal roof structure 10. It will be understood however, that each of the blankets 18 through 18*f* extends to the rafter beam 12. It will be further understood that one or more of the blankets 18 through 18*f* may extend beyond the rafter beam 12 to an adjacent bay (not shown). Although not required, an optional, second layer of blankets of insulative material, such as the blankets 18*i* and 18*j*, may be laid transversely to the first layer of blankets 18 through 18*h*, across the top of the purlin beams 14 through 14*g*. Only two blankets 18*i* and 18*j* of a second layer of blankets are shown so that other components of the metal roof structure 10 are visible. It will be understood that additional secondary blankets may be laid across the entire metal roof structure 10. It will be further understood that the illustrated blankets 18*i* and 18*j* may be formed as one integral blanket extending between the eave struts 16 and 16*a*.

Rigid roofing material such as metal decking 20 may then attached on top of the second layer of insulative blankets 18*i* and 18*j*. Only one section of metal decking 20 is shown. It will be understood however, that additional sections of metal decking 20 may be laid across the entire metal roof structure 10. It is generally customary to construct or finish the roof along the length of the structure from one endwall to an opposite endwall (i.e., in the direction of arrow 21), rather than from eave strut 16 to eave strut 16*a*. The workers assembling the roof structure 10 may stand on a previously laid section of the roof structure 10 while constructing an adjacent or next section. Alternatively, other assembly techniques may be used.

Various methods have been used to support the first layer of insulative blankets 18 through 18*h*. A known "banded liner system" is shown at 21 in FIG. 1 and described below. The illustrated banded liner system 21 includes a network or lattice of banding strips and a support sheet, such as a vapor barrier fabric sheet. The banded liner system 21 is configured to support the insulative blankets 18 through 18*h*. The banded liner system 21 may also define part of a fall protection system in which any workers or objects on the roof are protected from falling to the ground. When the building is fully assembled, the banded liner system 21 may define a vapor barrier as well as an aesthetically pleasing ceiling surface.

The illustrated banded liner system 21 includes mounting straps or banding that may be attached to the rafter beams 12 and 12*a* and the eave struts 16 and 16*a*. The banding may be arranged in a network or lattice structure. The banding may include first or longitudinal parallel banding strips 22 through 22*b* extending substantially parallel to the purlin beams 14 through 14*g* and second or transverse parallel banding strips 24 and 24*b* extending substantially transverse to the purlin beams 14 through 14*g*. Opposite distal ends of the parallel banding strips 22 through 22*b* are fixed to the upwardly facing surfaces of the rafter beams 12 and 12*a*. The opposite distal ends of the transverse banding strips 24 and 24*b* are similarly fixed to the downwardly facing surfaces of the eave struts 16 and 16*a*. It will be understood that only a portion of the parallel banding strips 22 through 22*b* and the transverse banding strips 24 and 24*b* are shown to allow other components of the metal roof structure 10 to be visible. However, a typical metal roof structure 10 may include parallel and transverse banding strips along the full perimeter defined by the rafter beams 12 and 12*a* and the eave struts 16 and 16*a*. In the illustrated embodiment, the parallel banding strips 22 through 22*b* and the transverse banding strips 24 and 24*b* are formed from steel. Alternatively, the parallel banding strips 22 through 22*b* and the transverse banding strips 24 and 24*b* may be formed from any other desired material, such as, aluminum, polypropylene, polyester, and other metal and non-metal material.

After the banding has been installed, a support sheet 26 may then be placed, typically by unfolding a pre-folded support sheet 26, onto the parallel banding strips 22 through 22*b* and the transverse banding strips 24 and 24*b*. At the intersection of each purlin beam 14 through 14*g* and the rafter beams 12 and 12*a*, the support sheet 26 may be notched to fit around the purlin beams 14 through 14*g*. In the illustrated embodiment, the support sheet 26 does not extend between the purlin beams 14 through 14*g* and the rafter beams 12 and 12*a*. The support sheet 26 may have a width extending the distance between the rafter beams 12 and 12*a* and a length extending the distance between the eave struts 16 and 16*a*. Typically, the support sheet 26 is made of polyethylene film, but the support sheet 26 may be formed from any other suitable material. Alternatively, the support sheet 26 may be made from any suitable material having sufficient tensile strength, tear strength, burst strength, and elongation to retain a four hundred (400) pound (181.5 kg) object dropped onto the banded liner system from a height of forty-two (42) inches (1.1 meters) above the support sheet 26.

After the support sheet 26 has been laid across the banding 22 through 22*b* and 24 through 24*b*, the support sheet 26 is fixed to the downwardly facing surfaces of the eave struts 16 and 16*a* and to the upwardly facing surfaces of the rafter beams 12 and 12*a*, similar to the banding. Also, the transverse banding strips 24 through 24*b* and the support sheet 26 may be fixed to the downwardly facing surfaces of the purlin beams 14 through 14*g*. Each connection of the support sheet 26 to one of the rafter beams 12 and 12*a*, to one of the eave struts 16 and 16*a*, and to one of the purlin beams 14 through 14*g* may be designated as an anchor point. After these connections are made, insulation cavities are defined between adjacent purlin beams 14 through 14*g* and further defined between the eave struts 16 and 16*a* and the purlin beams 14 through 14*g*, respectively. The blankets 18 through 18*h* may then be laid in place.

The above notwithstanding, there remains a need in the art for an improved fall protection for workers assembling the roof, as well as for other people having a need to be on the roof. To provide fall protection, the banded liner system should be configured to withstand an impact under pre-defined testing conditions. Specifically, the banded liner system must retain a four hundred (400) pound (181.5 kg) object dropped onto the banded liner system from a height of forty-two (42) inches (1.1 meters) above the walking working roof surface, typically the roof panel 20. This requirement is to ensure a worker assembling the roof will not fall through the support sheet 26 if the worker falls from the walking working roof surface 20.

SUMMARY OF THE INVENTION

The present application describes various embodiments of a novel roof structure of a building. The building has a pair of rafter beams and a pair of eave struts. The eave struts extend between, and are connected to the rafter beams. The roof structure further includes a plurality of first banding strips. The first banding strips have opposite distal ends extending between and connected to the rafter beams. A plurality of second banding strips has opposite distal ends extending between and connected to the eave struts. A support sheet is supported on the first and second banding strips, and a shock absorbing member is attached between the support sheet and one of the rafter beams or the eave struts.

Another embodiment of the novel a roof structure of a building is disclosed. The roof structure of the building has first and second rafter beams and an intermediate rafter beam between the first and second rafter beams. A first pair of eave struts extends between and is connected to the first and the intermediate rafter beams and defines a first bay. A second pair of eave struts extends between and is connected to the second and the intermediate rafter beams and defines a second bay. The novel banded liner system includes a plurality of first banding strips having opposite distal ends extending between and connected to the rafter beams in each bay. A plurality of second banding strips has opposite distal ends extending between and connected to the eave struts in each bay. A first support sheet is supported on the first and second banding strips in the first bay, and a second support sheet is supported on the first and second banding strips in the second bay. The first and the second support sheets are attached at a seam, which defines a shock absorbing joint.

An additional embodiment of the novel roof structure of a building is also disclosed, wherein the roof structure has a pair of rafter beams and a pair of eave struts extending between and connected to the rafter beams. A plurality of first banding strips has opposite distal ends extending between and connected to the rafter beams. A plurality of second banding strips has opposite distal ends extending between and connected to the eave struts. A primary support sheet is supported on the first and second banding strips, and a second support sheet is positioned on top of the primary support sheet. Outer peripheral edges of the primary support sheet are attached to each of the pair of rafter beams and the pair of eave struts, and an outer peripheral edge of the second support sheet is attached to one of (a) the pair of rafter beams and (b) the pair of eave struts.

BRIEF DESCRIPTION OF THE DRAWINGS

A complete appreciation of the invention and the many embodiments thereof will be readily obtained as the same becomes better understood by reference to the following detailed description when considered in connection with the accompanying drawings, wherein.

DETAILED DESCRIPTION

Figure 1:
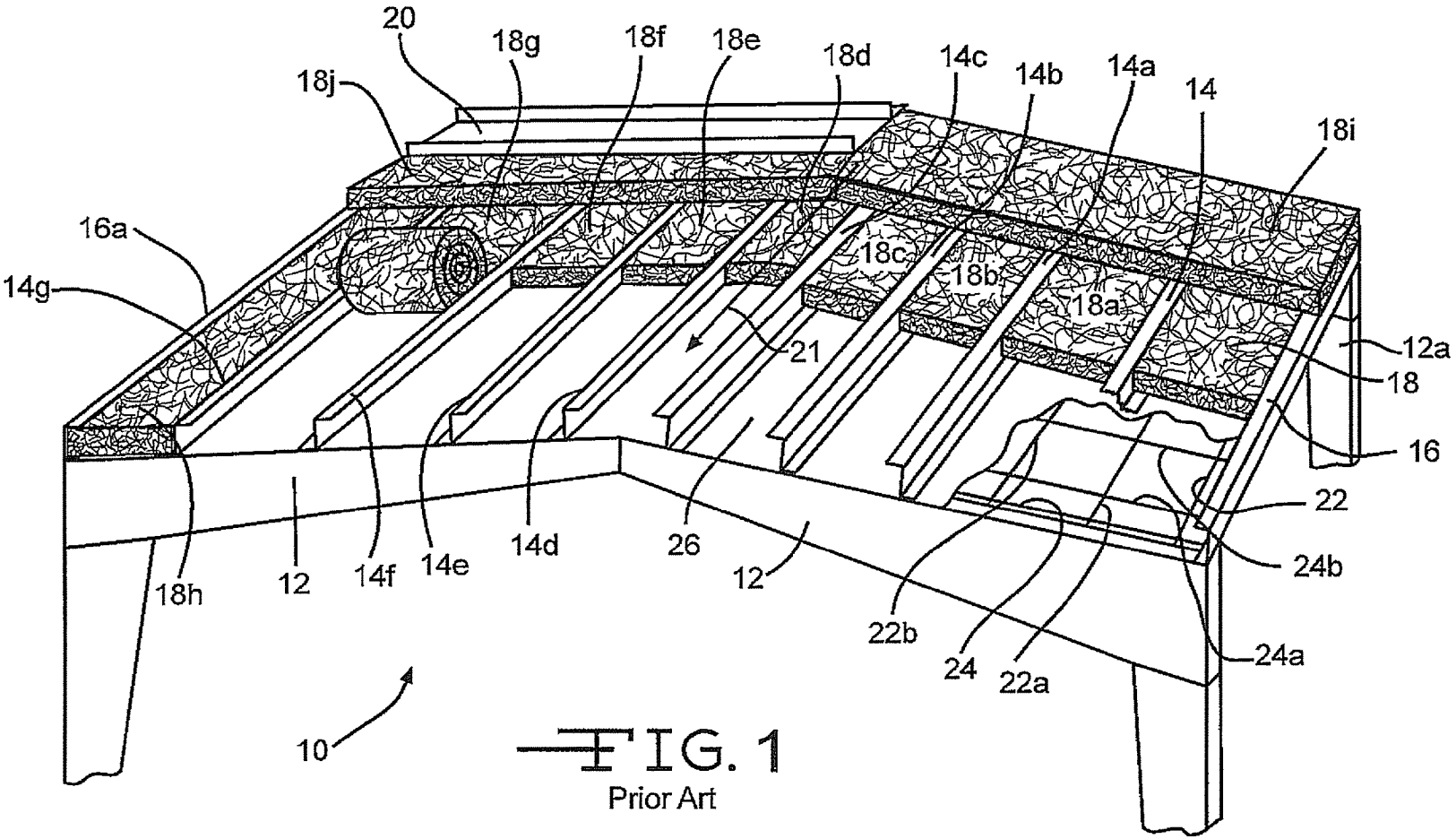
FIG. 1 Prior Art
FIG. 1 is a perspective view of a portion of a known insulated metal roof structure for use in commercial and industrial buildings.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

A deficiency in current and previous banded liner systems has been observed. Specifically, it has been observed that the support sheets in known banded liner systems are more likely to allow an object to pass to the ground when the object impacts the banded liner system proximate to the edges of the bay. The object may pass through a tear in the support sheet or pass between the support sheet and an edge of the bay. It is believed that when an object impacts the banded liner system proximate to the center of the bay, the load can be distributed more evenly over a greater number of anchor points. It is also believed that when the object impacts proximate to the center of the bay the support sheet itself can more readily deform, elastically or plastically, and thereby reduce the likelihood of tearing. Thus, when the object impacts proximate to the edges of the bay, a majority of the load is borne by fewer anchor points and the length or area over which the support sheet can deform without tearing is limited.

Various embodiments of an improved banded liner system with a shock absorber for the edges of the bay are described below. These embodiments are described in connection with the metal roof structure 10 set forth above. Alternative embodiments of the invention may also be practiced with forms of metal roofs other than the metal roof structure 10 described in this specification.

Figure 2:
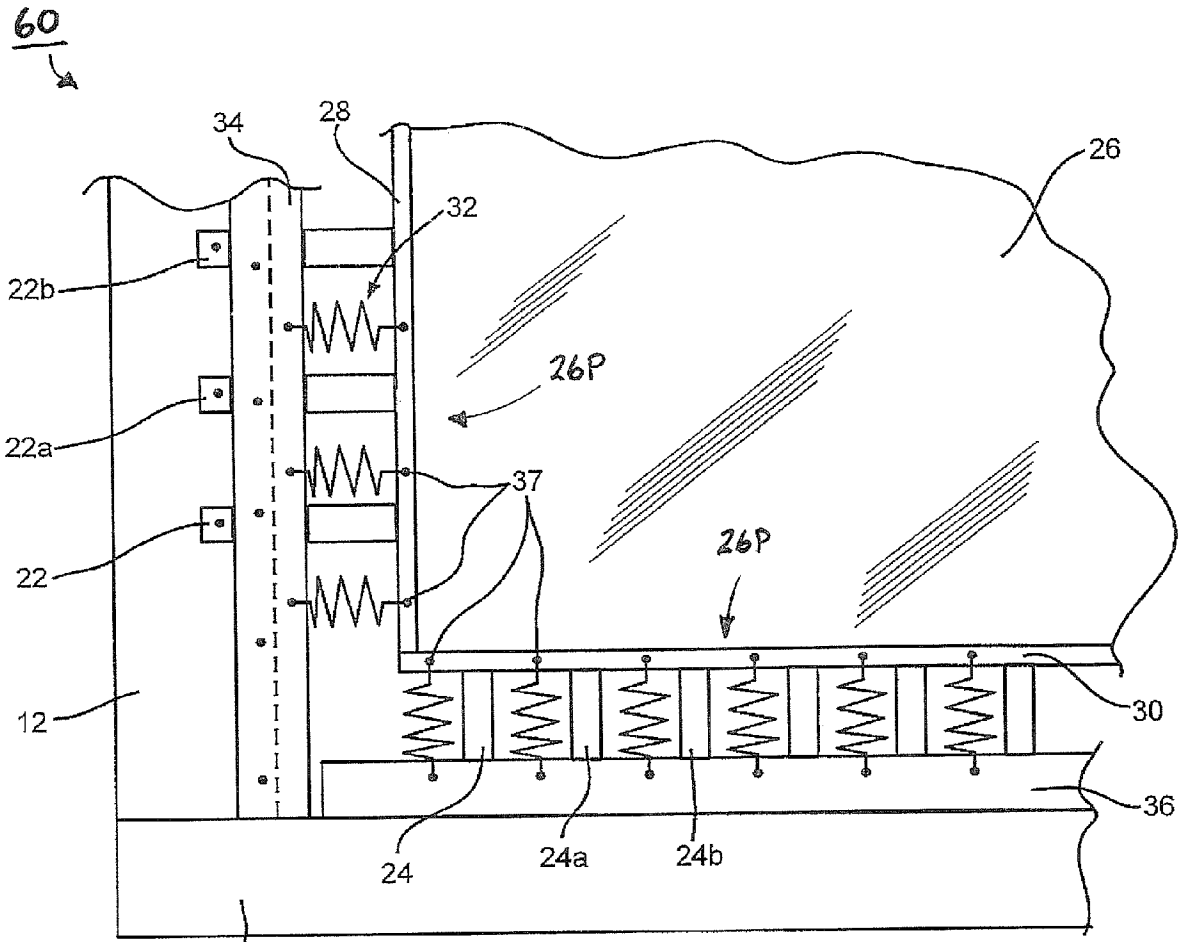
FIG. 2 is a top plan view of a portion of a first embodiment of a banded liner system according to the invention.

Referring now to FIG. 2, a first embodiment of a banded liner system is shown at 60 mounted to the metal roof structure 10. In the illustrated embodiment, the rafter beam 12 supports the eave strut 16. If desired, supplemental elongated mounting members 34 and 36 may be attached to the rafter beams 12 and eave struts 16, respectively. As shown in FIG. 2, the mounting member 34 may be mounted to a portion of an upper surface 12S such that the mounting member 34 extends inwardly toward the bay 8. The mounting member 34 may be attached to the rafter beam 12 by any desired means, such as with fasteners, schematically illustrated at 62 or by welding. Suitable fasteners include threaded fasteners, rivets, and the like. Similarly, the mounting member 36 may be mounted to a portion of the eave strut 16, such as a lower surface (not shown in FIG. 2), such that the mounting member 36 extends inwardly toward the bay 8. The mounting member 36 may be attached to the eave strut 16 by any desired means, such as with the fasteners 62 (not shown in FIG. 2), or by welding. In the illustrated embodiment, the mounting members 34 and 36 are formed from metal strip, such as aluminum strip. Alternatively, the mounting members 34 and 36 may be formed from any other desired material, such as composite panels. A plurality of first connecting apertures 35 may be formed in the mounting members 34 and 36.

The first embodiment of the banded liner system 60 includes the support sheet 26. The support sheet 26 may be made of any suitable material, such as polyethylene film. Alternatively, the support sheet 26 may be made from any suitable material having sufficient tensile strength, tear strength, burst strength, and elongation to retain a four hundred (400) pound (181.5 kg) object dropped onto the banded liner system from a height of forty-two (42) inches (1.1 meters) above the support sheet 26.

As shown in FIG. 2, the peripheral edges of the support sheet 26 are wrapped, folded, or rolled around an elongated edge reinforcement member 64 to define a perimeter zone 26P. The edge reinforcement member 64 may be any substantially rigid member such as a solid strip or a tube. In the illustrated embodiment, the edge reinforcement member 64 is formed from plastic. Alternatively, the edge reinforcement member 64 may be formed from any other desired material, such as wood and metal. Once wrapped, folded, or rolled, the perimeter zones 26P of the support sheet 26 define reinforced edges 28 and 30. The reinforced edges 28 and 30 may be secured with a sewn seam 26S, or with one or more clamps, only one of which is schematically illustrated at 66 in FIG. 2. Such clamps 66 may prevent the perimeter zones 26P of the support sheet 26 from becoming unwrapped, unfolded, or unrolled, and may further include a reinforced connecting aperture 37R for the springs 32 described below. Alternatively, the reinforced edges 28 and 30 may be secured with one or more clips 46, shown in FIG. 6 and described below. A plurality of second connecting apertures 37 may be formed in the reinforced edges 28 and 30. It will be understood that the edge reinforcement member 64 is not required, and the perimeter zone 26P may be formed from two or more layers of the support sheet 26 folded or rolled and secured with a sewn seam (not shown), or a with one or more clamps, such as the clamp schematically illustrated at 66.

The first embodiment of the banded liner system 60 further includes a plurality of the parallel banding strips, only three of which are shown at 22, 22*a*, and 22*b*, and a plurality of the transverse banding strips, only six of which are shown at 24, 24*a*, 24*b*, 24*c*, 24*d*, and 24*e*. The parallel banding strips 22, 22*a*, and 22*b* may be attached to the upper surface 12S of the rafter beam 12 by any desired means, such as with fasteners, schematically illustrated at 23. The fastener may be any suitable fastener such as threaded fasteners, rivets, and the like. The transverse banding strips 24 through 24*e* may be attached to the lower surface (not shown) of the eave strut 16 by any desired means, such as with the fasteners 23 (not shown in FIG. 2). The fastener may be any suitable fastener such as threaded fasteners, rivets, and the like.

The support sheet 26 may be attached to the metal roof structure 10 by a plurality of shock absorbing members. In the illustrated embodiment, the shock absorbing member is a spring, shown schematically at 32. The springs 32 extend between the first connecting apertures 35 formed in the mounting members 34 and 36 and the second connecting apertures 37 formed in the reinforced edges 28 and 30. The springs 32 may be any desired extension spring. Alternatively, other shock-absorbing structures may be used in lieu of the springs 32, such as flexible fabric and other resilient members, such as a rubber member. It will be understood that the mounting members 34 and 36 are not required, and the springs 32 may be connected directly to the rafter beam 12 and the eave strut 16 through connecting apertures (not shown) formed in the rafter beam 12 and the eave strut 16.

As shown in FIG. 2, the plurality of springs 32 may extend around the entire perimeter of the bay 8. Alternatively, the plurality of springs 32 may extend along only a portion of the perimeter of the bay 8. If desired, the support sheet 26 may be connected to any one of the purlin beams 14 through 14*g* (not shown in FIG. 2) in the same manner as the support sheet 26 is connected to the mounting member 36, described above. Advantageously, when an object falls such that it impacts the support sheet 26 proximate to the perimeter zones 26P of the support sheet 26, the springs 32 extend or elongate and absorb the force of the object's impact.

Figure 3A:
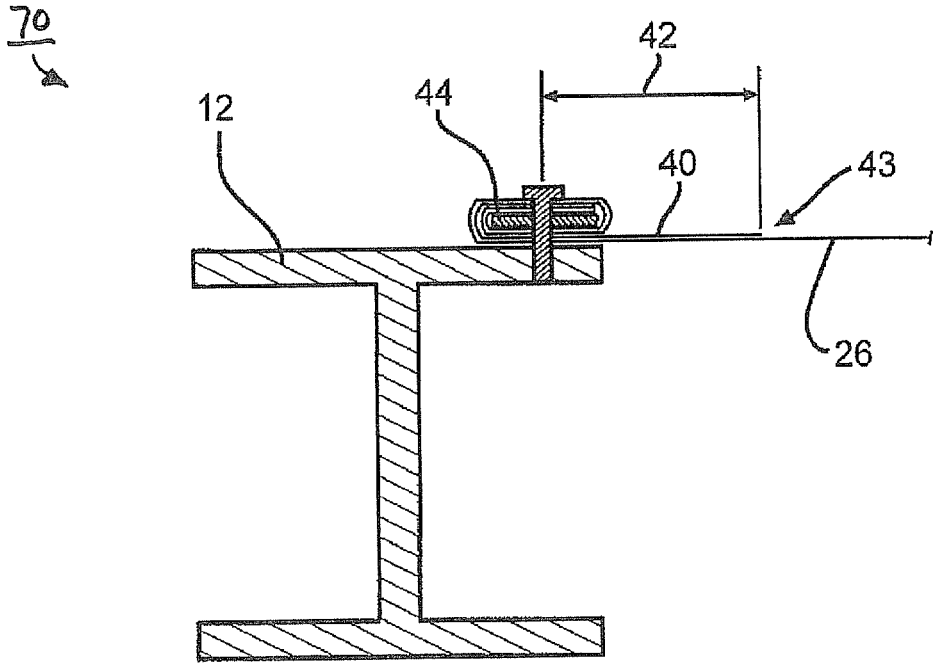
FIG. 3A is a cross-sectional side elevational view of a first portion of a second embodiment of the banded liner system illustrated in FIG. 2.
Figure 3B:
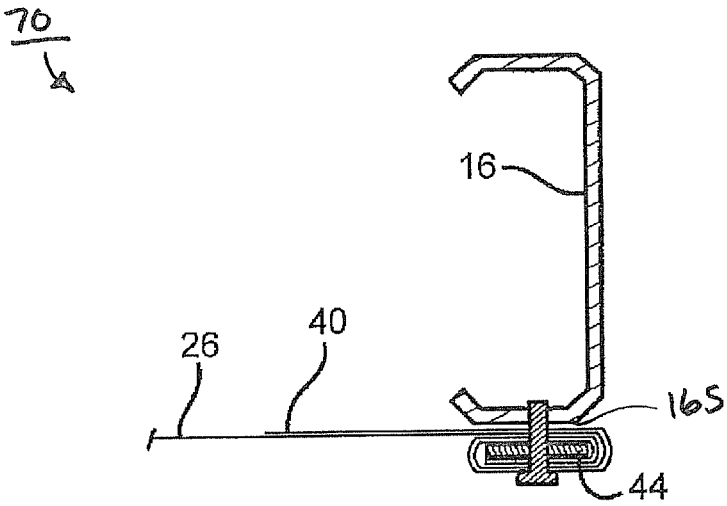
FIG. 3B is a cross-sectional side elevational view of a second portion of the second embodiment of the banded liner system illustrated in FIG. 3A.

Referring now to FIGS. 3A and 3B, a portion of a second embodiment of a banded liner system is shown at 70. Although not illustrated in FIGS. 3A and 3B, it will be understood that the second embodiment of the banded liner system 70 includes the parallel banding strips 22, 22*a*, and 22*b*, and the transverse banding strips 24, 24*a*, 24*b*, 24*c*, 24*d*, and 24*e*, such as shown in FIG. 2.

The illustrated banded liner system 70 includes a first or primary support sheet 27, and a secondary support sheet 40. In the illustrated embodiment, the primary support sheet 27 is formed from the same material as the support sheet 26. As shown in FIG. 3A, a portion of the secondary support sheet 40 is positioned on top of the support sheet 27 and extends inwardly from the rafter beam 12 a predetermined distance 42 toward the bay 8. In the illustrated embodiment, the distance 42 is about six (6) feet (1.83 meters). Alternatively, the distance 42 may be other desired distances, such as within the range of from about 1.0 foot (0.31 meters) to about 12.0 feet (3.66 meters). The secondary support sheet 40 may be formed from the same material as the primary support sheet 27, such as polyethylene film, or any other suitable material. In the illustrated embodiment, the outer peripheral edges of the primary support sheet 27 and the secondary support sheet 40 are wrapped, folded, or rolled around an elongated edge reinforcement member 44.

The edge reinforcement member 44 may be any substantially rigid member such as a solid strip or a tube. In the illustrated embodiment, the edge reinforcement member 44 is formed from metal, such as sheet metal. Alternatively, the edge reinforcement member 44 may be formed from any other desired material, such as wood and plastic. Once wrapped, folded, or rolled around the edge reinforcement member 44, the peripheral edges of the primary support sheet 27 and the secondary support sheet 40 define a reinforced perimeter zone 74P. The perimeter zone 74P may be attached to the upper surface 12S of the rafter beam 12 by any desired means, such as with fasteners 72. The fasteners 72 may be any suitable fastener such as threaded fasteners, rivets, and the like. An inwardly facing edge 43 of the secondary support sheet 40 extends inwardly toward the bay 8. In the illustrated embodiment, the portion of the secondary support sheet 40 between the perimeter zone 74P and the inwardly facing edge 43 rests upon, but is not attached or bonded to, the primary support sheet 27.

Referring now to FIG. 3B, a portion of the second embodiment of the banded liner system 70 is shown attached to a lower surface 16S of the eave strut 16 with a plurality of the fasteners 72. In the embodiment of the banded liner system 70 illustrated in FIGS. 3A and 3B, the primary support sheet 27 is configured to extend between the rafter beams 12 in one direction and between the eave struts 16 in a second direction such as to cover the entire bay 8. Advantageously, the secondary support sheet 40 acts as a shock absorber by providing an additional layer which may deform and absorb the force of impact of a falling object. For example, when an object falls such that it impacts the secondary support sheet 40 proximate to the perimeter zone 74P, the secondary support sheet 40 may stretch or deform and absorb the force of the falling object's impact without tearing, even if the primary support sheet 27 is torn beyond a desired amount. Any undesirable tear in the primary support sheet 27 will also remain covered by the secondary support sheet 40.

Figure 4A:
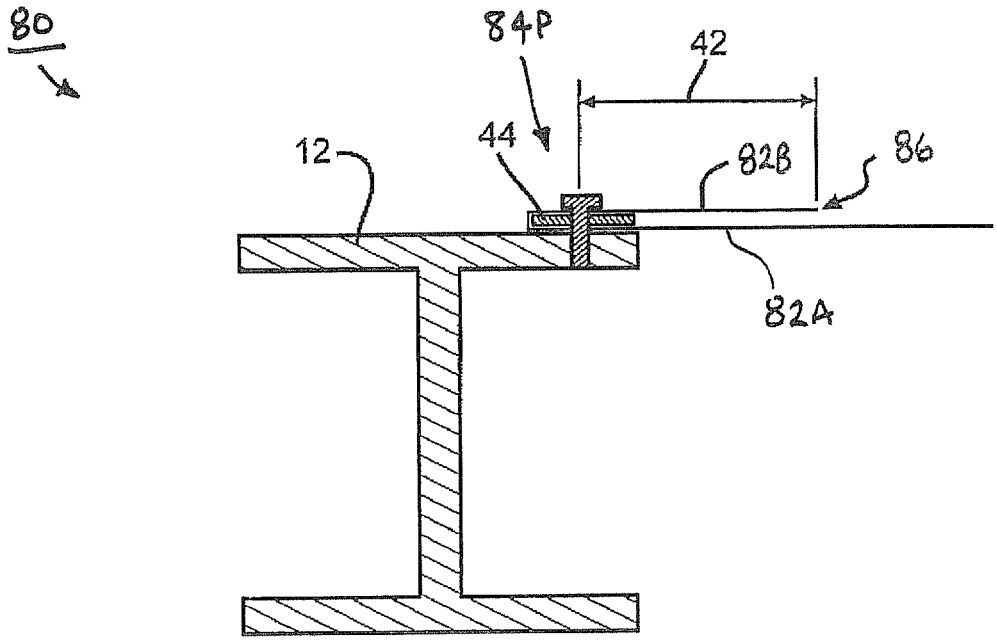
FIG. 4A is a cross-sectional side elevational view of a first portion of a third embodiment of the banded liner system illustrated in FIG. 2.
Figure 4B:
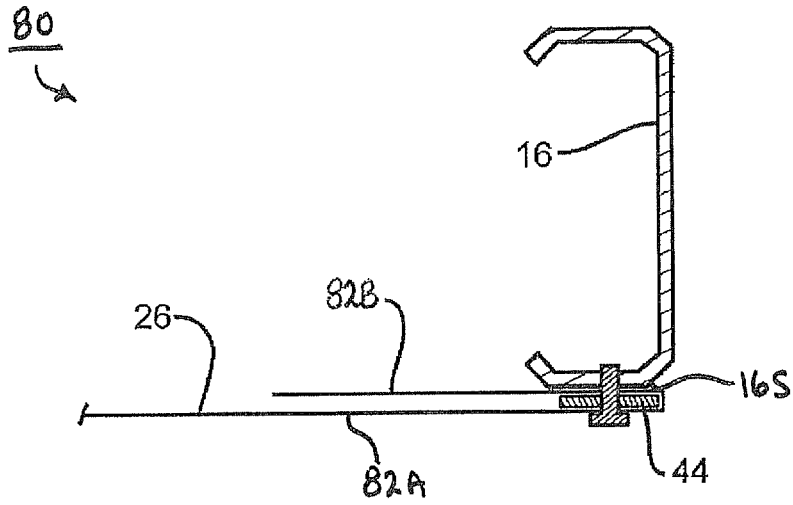
FIG. 4B is a cross-sectional side elevational view of a second portion of the third embodiment of the banded liner system illustrated in FIG. 4A.

Referring now to FIGS. 4A and 4B, a portion of a third embodiment of a banded liner system is shown at 80. Although not illustrated in FIGS. 4A and 4B, it will be understood that the third embodiment of the banded liner system 80 includes the parallel banding strips 22, 22*a*, and 22*b*, and the transverse banding strips 24, 24*a*, 24*b*, 24*c*, 24*d*, and 24*e*, such as shown in FIG. 2.

The illustrated banded liner system 80 includes the support sheet 26. As shown in FIG. 4A, a portion of the support sheet 26 is wrapped or folded around the elongated edge reinforcement member 44 and defines a first or primary support sheet portion 82A and a second support sheet portion 82B. The second support sheet portion 82B of the support sheet 26 is positioned on top of the first support sheet portion 82A and extends inwardly from the rafter beam 12 the predetermined distance 42 toward the bay 8.

Once wrapped or folded around the edge reinforcement member 44, the edge reinforcement member 44 and the wrapped portion of the support sheet 26 define a reinforced perimeter zone 84P. The perimeter zone 84P may be attached to the upper surface 12S of the rafter beam 12 by any desired means, such as with the fasteners 72. An inwardly facing edge 86 of the second support sheet portion 82B extends inwardly toward the bay 8. In the illustrated embodiment, the second support sheet portion 82B rests upon, but is not attached or bonded to, the first support sheet portion 82A.

Referring now to FIG. 4B, a portion of the third embodiment of the banded liner system 80 is shown attached to a lower surface 16S of the eave strut 16 with a plurality of the fasteners 72. Advantageously, and similar to the second embodiment of the banded liner system 70, the illustrated third embodiment of the banded liner system 80 illustrated in FIGS. 4A and 4B allow the support sheet 26 to extend between the rafter beams 12 in one direction and the eave struts 16 in a second direction such as to cover the entire bay 8. Advantageously, the secondary support sheet 40 acts as a shock absorber by providing an additional layer which may deform and absorb the force of impact of a falling object as described in regards to the embodiment illustrated in FIGS. 3A and 3B above.

If desired, the first support sheet portion 82A and the second support sheet portion 82B may be formed from different materials and bonded together such as by sewing. For example, the second support sheet portion 82B may be formed from a material that is more elastic than the first support sheet portion 82A. Additionally, the first support sheet portion 82A may be formed from a material that is stronger than the second support sheet portion 82B, and therefore able to absorb most of the force of a falling object. The second support sheet portion 82B, on its own, may not be capable of withstanding the force of an impact from a falling object. The second support sheet portion 82B may however, be capable of stretching without tearing to a point at which the first support sheet portion 82A has stabilized after the impact of the falling object. Thus, first support sheet portion 82A may tear beyond a desired amount while the second support sheet portion 82B remains un-torn, or only slightly torn. Examples of possible materials for the second support sheet portion 82B include the material used to form Glad FORCE-FLEX® trash bags, flexible polyethylene film such as VISQUEEN brand film, or elastic netting. Such a choice of materials ensures that the impact of a falling object may be absorbed and, at the same time, ensures that an unacceptable tear will remain covered by the second support sheet portion 82B.

Figure 5:
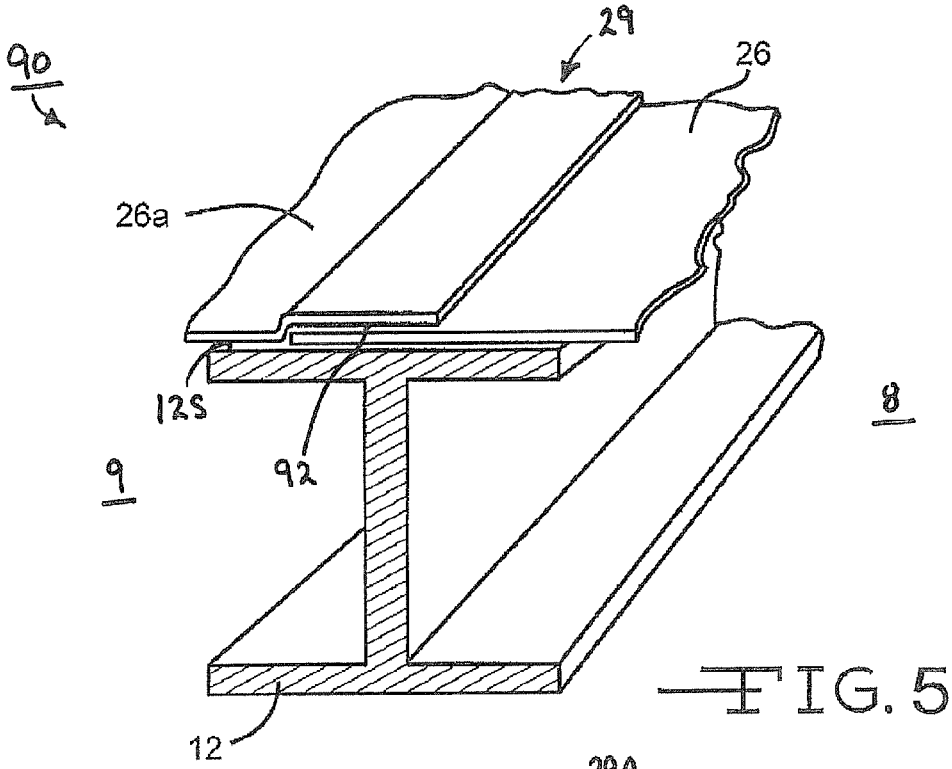
FIG. 5 is a perspective view of a portion of a fourth embodiment of the banded liner system according to the invention.

Referring now to FIG. 5, a fourth embodiment of the banded liner system 90 is shown. As discussed above and illustrated in FIG. 1, a bay is the area bounded by adjacent rafter beams 12 and opposing eave struts 16. A roof structure 10 may be defined by a plurality of bays. The fourth embodiment of the banded liner system 90 is adapted for roofs with multiple bays. As shown in FIG. 5, the banded liner system 90 includes the support sheet of one bay attached to the support sheet of an adjacent bay, rather than either or both of the support sheets being attached to the rafter beam 12 separating the bays.

In FIG. 5, a first support sheet 26 is illustrated covering a first bay 8, and a second support sheet 26*a* is illustrated covering a second bay 9 adjacent to the first bay 8. Adjacent peripheral edge portions of the first and second support sheets 26 and 26*a* overlap and are attached together at a seam 92. The seam 92 extends along the upper surface 12S of the rafter beam 12. The attached first and second support sheets 26 and 26*a* define a support sheet assembly 29.

The support sheet assembly 29 provides an advantageous shock absorbing capability to the banded liner system 90. Because neither the seam 92 between the first and second support sheets 26 and 26*a*, nor the first and second support sheets 26 and 26*a* are attached to the upper surface 12S of the rafter beam 12, both sheets 26 and 26*a* may move upon impact from a falling object. For example, the force of impact of a falling object on the first support sheet 26 will urge the first support sheet 26 downwardly as the second support sheet 26*a* is pulled toward the first support sheet 26 and the point of impact. As a result, a distance over which either support sheet 26 or 26*a* may elongate under impact loading from a falling object is increased relative to a support sheet fixedly attached between two rafter beams 12. Thus, the support sheet assembly 29 is configured to act as a shock absorber. For example, the force of impact of a falling object on the first support sheet 26 will urge the first support sheet 26 downwardly as the second support sheet 26*a* is pulled toward the first support sheet 26 and the point of impact. The seam 92 may be formed by any desired means such as with an adhesive. Alternatively, the seam 92 may be formed by welding.

Figure 6:
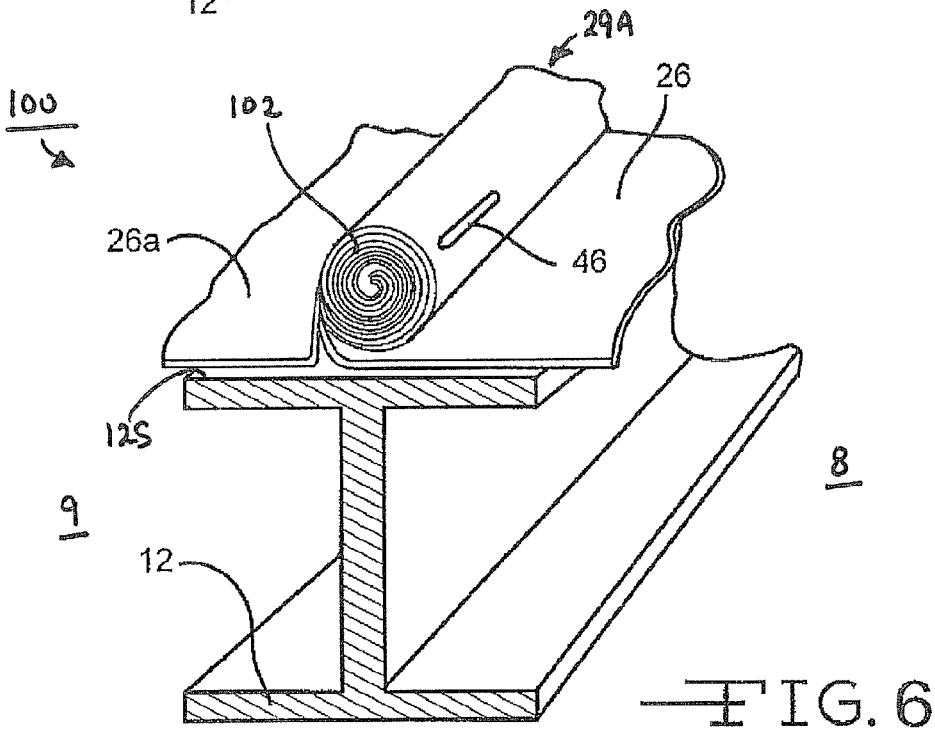
FIG. 6 is a perspective view of a portion of a fifth embodiment of the banded liner system according to the invention.

Referring now to FIG. 6, a fifth embodiment of the banded liner system 100 is shown. The banded liner system 100 is similar to the banded liner system 90 and includes the first support sheet 26 covering a first bay 8 attached to the second support sheet 26*a* covering a second bay 9 adjacent to the first bay 8. As shown in FIG. 6, adjacent peripheral edges of the first and second support sheets 26 and 26*a* are rolled together to define a rolled seam 102. The rolled seam 102 extends along the upper surface 12S of the rafter beam 12. The attached first and second support sheets 26 and 26*a* define a support sheet assembly 29A. One or more clips 46 pierce or extend into the rolled seam 102 to prevent unrolling. The support sheet assembly 29A provides an advantageous shock absorbing capability to the banded liner system 100, as described above.

Figure 7:
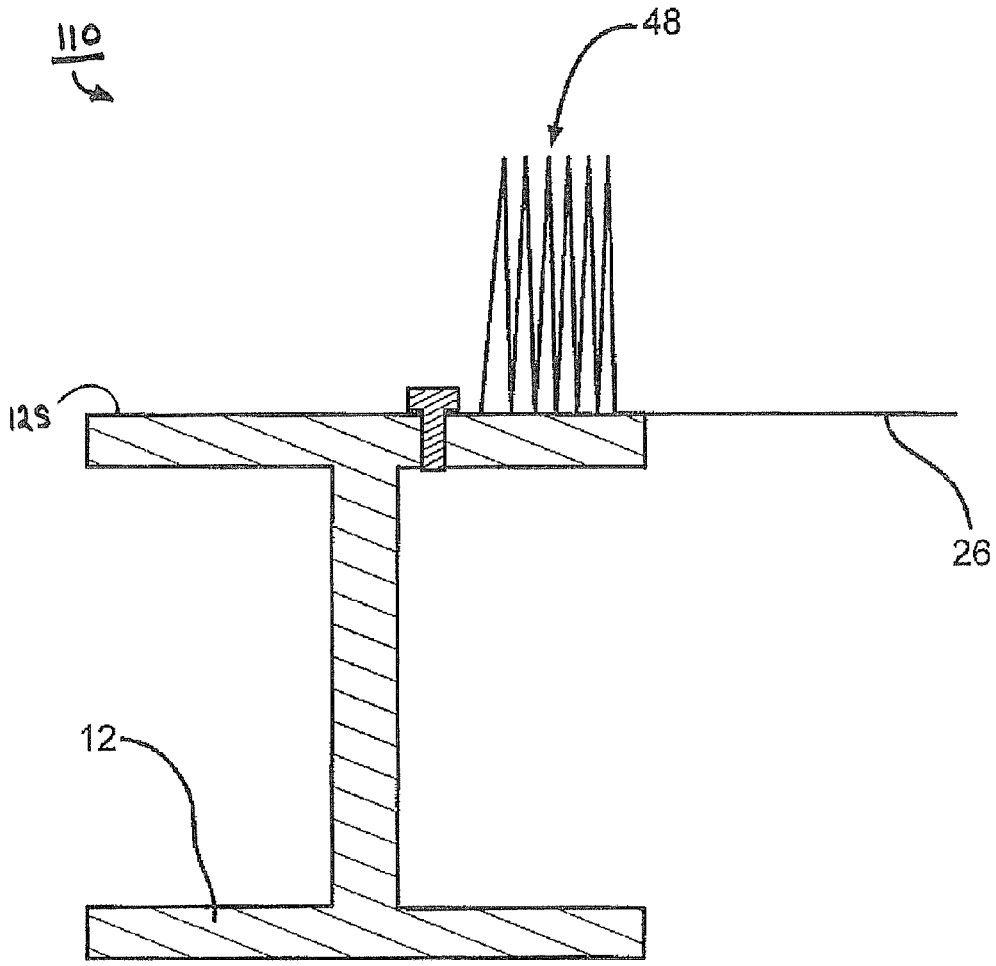
FIG. 7 is a side elevational view of a portion of a sixth embodiment of the banded liner system according to the invention.

Referring now to FIG. 7, a portion of a sixth embodiment of a banded liner system is shown at 110. Although not illustrated in FIG. 7, it will be understood that the sixth embodiment of the banded liner system 110 includes the parallel banding strips 22, 22*a*, and 22*b*, and the transverse banding strips 24, 24*a*, 24*b*, 24*c*, 24*d*, and 24*e*, such as shown in FIG. 2.

The illustrated banded liner system 110 includes the support sheet 26. As shown in FIG. 7, the support sheet 26 includes a first or outwardly facing edge portion 112, a second or inwardly facing edge portion 114 extending inwardly toward the bay 8, and a pleated portion 48 having a plurality of pleats 48P intermediate the first and second edge portions 112 and 114. The first edge portion 112 may be attached to the upper surface 12S of the rafter beam 12 by any desired means, such as with the fasteners 72.

The pleated portion 48 may include a stitched seam 116, wherein the pleats 48P of the pleated portion 48 are sewn together with thread of a predetermined strength. The strength of the thread defining the stitched seam 116 may be selected such that upon impact of an object, one or more pleats 48P separates from the remaining pleats 48P, allowing the pleat 48P to straighten and the support sheet 26 to extend inwardly toward the bay 8. The strength of the thread may be selected such that upon impact of a falling object, all of the pleats 48P separate from one another and straighten. The pleats 48P may be joined by threads of different strength. For example, the thread joining a first and second of the pleats 48P may have a strength lower than the thread joining a third and a fourth of the pleats 48P. In operation, the force of the impact of a falling object may cause the first and second pleats 48P to separate and straighten initially and, only if the impact loading is not yet absorbed, will the third and fourth pleats then separate and straighten.

It will be understood that the thread described above defines controlled weakness points in the support sheet 26. Alternatively, adhesive, clips, or other suitable mechanisms may be used in lieu of thread to bind and maintain the pleats 48P together. It will be further understood that other forms of controlled weakness points may be applied in alternative embodiments of the invention. For example, the support sheet 26 may be formed with slits that open in response to the impact of the object.

It will be appreciated that the several embodiments illustrated in FIGS. 2 through 7, inclusive, may be practiced together in whole or in part. For example, the springs 32 of the first embodiment of the banded liner system 60 may be applied along the eave struts 16 and the reinforced perimeter zone 74P of the second embodiment of the banded liner system 70 may be applied along the rafter beams 12. Alternatively, other combinations of the several embodiments of the banded liner system may be used.

The embodiments of the embodiment of the banded liner systems 60, 70, 80, 90, 100, and 110 have each been described as including the parallel banding strips 22, 22*a*, and 22*b*, and the transverse banding strips 24, 24*a*, 24*b*, 24*c*, 24*d*, and 24*e*, such as shown in FIG. 2. It will be understood however, that the various embodiments of the support sheet described may be used in and attached to a roof structure as described about without such banding strips.

The present invention should not be considered limited to the specific examples described herein, but rather should be understood to cover all aspects of the invention. Various modifications, equivalent processes, as well as numerous structures and devices to which the present invention may be applicable will be readily apparent to those of skill in the art. Those skilled in the art will understand that various changes may be made without departing from the scope of the invention, which is not to be considered limited to what is described in the specification.

What is claimed is:

1. A roof structure of a building including a banded liner system, the roof structure including first and second rafter beams and an intermediate rafter beam between the first and second rafter beams, wherein a first pair of eave struts extend between and are connected to the first and the intermediate rafter beams and define a first bay, and wherein a second pair of eave struts extend between and are connected to the second and the intermediate rafter beams and define a second bay, the banded liner system comprising:

a plurality of first banding strips having opposite distal ends, the distal ends extending between and connected to the rafter beams in each bay;

a plurality of second banding strips having opposite distal ends, the distal ends extending between and connected to the eave struts in each bay;

a first support sheet supported on the first and second banding strips in the first bay, the first support sheet having a first peripheral edge and a second peripheral edge; and a second support sheet supported on the first and second banding strips in the second bay, the second support sheet having a first peripheral edge and a second peripheral edge;

wherein the first peripheral edge of the first support sheet is attached to the first rafter beam, wherein the second peripheral edge of the first support sheet is proximate but not attached to the intermediate rafter beam, wherein the first peripheral edge of the second support sheet is attached to the second rafter beam, wherein the second peripheral edge of the second support sheet is proximate but not attached to the intermediate rafter beam, wherein the second peripheral edge of the first support sheet is attached to the second peripheral edge of the second support sheet to form a seam, wherein the seam is operable to move toward the first rafter beam in response to a force exerted on the first support sheet, and wherein the seam is operable to move toward the second rafter beam in response to a force exerted on the second support sheet.

2. The roof structure according to claim 1, wherein the second peripheral edge of the first support sheet and the second peripheral edge of the second support sheet overlap with one another and are bonded together to define the seam.

3. The roof structure according to claim 1, further including an edge reinforcement member attached to at least one of the first peripheral edge of the first support sheet and the first peripheral edge of the second support sheet.

4. The roof structure according to claim 3, wherein the at least one of the first peripheral edge of the first support sheet and the first peripheral edge of the second support sheet is wrapped around the edge reinforcement member to define a reinforced edge.

5. The roof structure according to claim 1, wherein the first and the second support sheets are attached at the seam using an adhesive.

6. The roof structure according to claim 1, wherein the first and the second support sheets are attached at the seam by welding.

7. The roof structure according to claim 1, wherein the first support sheet substantially covers the first bay.

8. The roof structure according to claim 1, wherein the second support sheet substantially covers the second bay.

9. The roof structure according to claim 1, wherein the seam extends along an upper surface of the intermediate rafter beam.

10. The roof structure according to claim 1, wherein no portion of the first support sheet is attached to the intermediate rafter beam; and wherein no portion of the second support sheet is attached to the intermediate rafter beam.

11. The roof structure according to claim 1, wherein an insulative material is placed directly on the first support sheet; and wherein an insulative material is placed directly on the second support sheet.

* * * * *